US005472297A

United States Patent [19]

Heselden

[11] Patent Number: 5,472,297

[45] **Date of Patent: * Dec. 5, 1995**

[54] BUILDING AND SHORING BLOCKS

[75] Inventor: James W. Heselden, Leeds, England

[73] Assignee: Hesco Bastion Limited, Leeds, England

[ * ] Notice: The portion of the term of this patent subsequent to Aug. 2, 2011, has been disclaimed.

[21] Appl. No.: 226,568

[22] Filed: Apr. 12, 1994

Related U.S. Application Data

[63] Continuation of Ser. No. 776,268, filed as PCT/GB90/00485, Apr. 2, 1990, Pat. No. 5,333,970.

[30] Foreign Application Priority Data

| | | | |
|---|---|---|---|
| Apr. 7, 1989 | [GB] | United Kingdom | 8907832 |
| Jul. 10, 1989 | [GB] | United Kingdom | 8922639 |
| Oct. 24, 1989 | [GB] | United Kingdom | 8923934 |
| Jan. 20, 1990 | [GB] | United Kingdom | 9001376 |

[51] Int. Cl.[6] ..... E02D 29/02

[52] U.S. Cl. ..... 405/286; 405/32; 405/258

[58] Field of Search ..... 405/15, 16, 19, 405/21, 30, 32, 258, 284, 286, 287, 287.1

[56] References Cited

U.S. PATENT DOCUMENTS

| | | | |
|---|---|---|---|
| 4,011,728 | 3/1977 | Turzillo | 405/222 |
| 4,394,924 | 7/1983 | Zaccheroni | 405/32 X |
| 4,483,640 | 11/1984 | Berger et al. | 405/15 |
| 4,572,705 | 2/1986 | Vignon . | |
| 4,594,206 | 6/1986 | Grafton | 405/32 X |
| 4,655,637 | 4/1987 | Vignocchi | 405/32 X |
| 4,726,708 | 2/1988 | Papetti | 405/19 |
| 5,333,970 | 8/1994 | Heselden | 405/286 |

FOREIGN PATENT DOCUMENTS

| | | | |
|---|---|---|---|
| 968726 | 6/1975 | Canada | 405/32 |
| 788004 | of 1935 | France . | |
| 987242 | 8/1951 | France | 405/32 |
| 2526127 | 11/1983 | France . | |
| 845863 | 8/1960 | United Kingdom . | |

*Primary Examiner*—David H. Corbin
*Attorney, Agent, or Firm*—Klauber & Jackson

[57] ABSTRACT

The invention provides that wire mesh cage structures (22) are used to provide structural blocks usable in building, shoring walls and the like. The cage is lined with a geotextile fibrous material (24) which allows the passage therethrough of water, but not particulate material (26) such as cement, sand aggregate which are used as materials for filling the cage. The invention discloses novel forms of cage structure and also that the finished blocks can be coated with curable synthetic resin to conceal the mesh and provide a decorative finish.

11 Claims, 5 Drawing Sheets

BUILDING AND SHORING BLOCKS

This is a Continuation of application Ser. No. 07/776,268, filed as PCT/GB90/00485, Apr. 2, 1990, now U.S. Pat. No. 5,333,970.

This invention relates to building and shoring structures in the form of blocks, and in particular concerns building and shoring blocks which comprise a metallic mesh cage which is filled with ballast material.

Certain of each structures are known by the name "gabions" and comprise essentially wire mesh cages defining a block shape, which are filled with rock, stone and rubble and the like. The stone is generally placed immediately inside the cage surface so as to be visible through the cage, and in this connection the stone typically is dressed and laid in the nature of a wall so as to have an enhanced appearance, as frequently the stone surfaces are left exposed to view. This may apply for example when the gabions are used, as they are extensively, for the shoring up of an embankment for example adjacent a motorway or for forming a sea defence or the like.

Although these gabions are made up of wire mesh cages filled with stone and other rubble, in effect they become solid blocks which can be used for building, shorings for hillsides, sea walls and the like, for walls and for other purposes.

However, the method of filling the wire mesh cages in using facing stone is expensive, and furthermore considerable time and effort is required in filling the gabion cages. Obviously the stone and other rubble is required in accordance with the conventional method of construction, because otherwise the material would simply pass through the meshes of the wire mesh cage.

In the instant invention however, structural blocks, which can be used as gabions and for other purposes are provided whereby a much looser particulate, fluent material such as sand, concrete, ash and soil colliery waste and small particular aggregate can be used as the ballast material either singly or in combination with other material without the disadvantage of the known gabion structures arising, and in accordance with the invention in a first aspect there is provided a method of providing an on site structural block comprising providing at the site a cage conforming to the shape of the block to be provided, said cage comprising at least partially open work mesh, and at least partially lining the interior of said cage with flexible sheet material, and filling the cage at least partially with fluent solid material of a particulate nature which, but for the lining material, would pass through the meshes of the cage. The fluent solid material can in fact be any of a wide range of materials. Thus it may be mixed with water and pumped into the cage which may or may not as required allow the water to escape leaving a solid mass of small particles as the infill. Again, synthetic resin systems which may be foamable or not can be used, such systems being of a nature which are liquid when poured into the cage and solidify and fill the cage interior to form the ballast.

The flexible lining material may comprise a flexible fabric, mat or a plastic film, or metallic foil or a laminate or a combination of materials, but in any event it simply forms a barrier layer whereby the ballast will be retained inside the gabion mesh even if the ballast material is something which is as loose and as small in particulate size, as builders sand. The barrier layer may be a pre-impregnated fibrous mat or felt or the like which cures hard after positioning in the cage.

By this arrangement, when the invention is used for gabion cages, the flexibility of use of gabion structures is considerably increased, because the range of ballast materials which can be used is substantially increased. It is usual for example for quantities of sand or other particulate material to be more readily available than dressed stone.

To further enhance a gabion structure according to the invention, it may after it has been placed in operative position be oversprayed or coated by means of a curable synthetic composition, for example a polyester or epoxy resin composition to fully cover the wire mesh to prevent corrosion from hostile atmospheres and which resin composition may or may not be provided with glass fibre reinforcement and/or colouring for enhancing the overall effect. Such resin material when cured can be arranged to anchor aggresively to the wire mesh cage structure and also the barrier layer, especially when the barrier layer is a pre-preg, thereby in fact somewhat concealing the gabion from view and creating a pleasant appearance. The application of the synthetic resin may be by spray or the like, and the resin can be applied in any appropriate quantity. The barrier layer may be absorbent in nature so as to soak up at least some of the resin.

It is technically possible to prepare the gabion cages under factory conditions, and to fill and coat the cages in the factory and then transport same to site, but it is preferred that the gabions be filled on site and subsequently coated when placed in position.

The invention also applies to the formation of concrete structures such as footings, ring beams, columns, bases, and generally any structure or formation including concrete or concrete like material, with or without steel reinforcement, and in using the present invention in this regard the utilisation of conventional concrete shuttering can be eliminated.

When casting a concrete structure, it is necessary to provide shuttering, which may be in the form of boards or plates shaped to form a cavity to be filled with the concrete in order to form the eventual structure. The provision of such shuttering is time consuming and costly, and if timber shuttering, which is the most popular type, is used, then invariably skilled joinery craftsmen are required to erect the shuttering prior to the pouring of the concrete.

Concrete footings are used extensively in the erection of buildings, especially tall buildings, such as office blocks, and such footings have to be set into the ground, usually under ground level to take the anticipated massive building loads.

When the ground is excavated for the provision of such footings, the erection of shuttering at under ground level is complicated.

In accordance with a preferred feature of the present invention therefore, a concrete structure is produced by filling the cage at least partially with concrete to form the concrete structure, and the flexible sheet material is water porous having the characteristic which allows water to pass thereto but prevents the concrete from exuding through the mesh when poured into the cavity.

By this means and method, concrete structures can be formed rapidly and readily. The cage forms the support for the concrete as it is poured into the cavity, whilst the said flexible sheet material forms a means for allowing the water quickly to percolate from the poured concrete and to enhance the setting speed of the concrete.

When compared with the conventional shuttering method several highly significant advantages result.

Firstly, when concrete is poured into a cavity defined by conventional shuttering, moisture in the concrete can escape from the mix only through the surface of the body of concrete and, therefore, the curing rate is slow. With the instant invention, however, the water immediately starts to percolate through the lining material so that curing commences immediately, and final curing takes place at a faster rate. Secondly, the cage can, especially where the concrete structure is a footing which will be underground and will be covered in the final building in which it is embodied, can remain with the cast concrete, and it is not necessary to erect and remove shuttering as in the conventional shuttering method. Thirdly, the cage can be pre-formed under factory conditions, and it is not necessary to erect shuttering on site; therefore, it is not necessary to have skilled joiners on site, who may in inclement weather in any event be unable to work, which can delay the completion of the project.

It is preferred that where the cage forms a side wall to support the poured concrete, that there should be reinforcing restraining means which may be in the form of a partition restraining the cage walls from bowing or bulging outwardly under the gravitational effect of the poured concrete. It may be possible to mitigate the need for this restraining means if the concrete is poured into the cavity sequentially and at intervals so that a first layer of concrete is poured into the bottom of the cavity and after a predetermined time when the concrete has been given an opportunity at least partially to set a second layer of similar thickness is deposited in the cavity, and this procedure is repeated until such times as the cavity has been filled to the required extent. By this arangement, the partial rigidity of the previously poured layer of concrete assists in maintaining the side wall or walls of the cage means in the correct configuration.

The poured concrete may be vibrated for the homogenisation and levelling of same in accordance with conventional practice.

The utilisation of the cage and flexible sheet material to form the support for the poured concrete means that, as indicated above, the cage can be pre-fabricated to any desired shape, and for certain shapes the cage may be of a type which is collapsible to a flat condition making it suitable for transportation to the site, and so that it can be easily erected and filled on site by relatively unskilled personnel.

If the cage is provided with internal partitions, these partitions can be used, if they are of mesh construction, for suspending steel reinforcement bars in predetermined position, and therefore the partitions can serve two purposes one of which is to keep the cage walls in desired position and the other of which is to support reinforcement rods.

The utilisation of a cage may also permit a removal of the restrictions on the shape of the cavity which can be constructed using conventional shuttering. Thus, if building footings for supporting the main columns traditionally are of square box configuration because square box configuration is the easiest configuration to be constructed using conventional shuttering, it may be possible to replace such a square footing with a cylindrical footing by simply forming a length of the open work mesh as used in the present invention into circular configuratiion with the inner surface of the cage being lined with the said water porous material.

The said material is preferably the known geo-textile material sold by Dupont and I.C.I., and which is designed to allow water to pass through the material, but to prevent solid particles which are in a pasty condition from exuding through the material, even although pressed strongly thereagainst.

The present invention also applies in another aspect to a cage structure for use in providing structural blocks, and in accordance with this aspect of the present invention there is provided a cage structure adapted to be filled with a filling material in order to provide a structural block, said cage structure comprising a wall or walls at least partially defined by open work mesh, and a lining material lying to the inside of said open work mesh to enable the cage to be filled with a particulate material which would pass through the open work mesh were it not for the presence of the lining material.

Preferably, the cage is made up of a plurality of hingedly interconnected panels of said open work mesh enabling the cage to be collapsed between flattened and erected conditions, and wherein said lining material is connected to the insides of the panels forming the walls of the cage and folds with the folding of the cage panels between the collapsed and erected conditions.

Also, it is preferred that the cage when erected is of rectangular configuration defining side walls, end walls and a base, the base being pivotally connected at one side to the lower edge of one of the side walls, and the side and end walls being hingedly interconnected at the corners of the rectangular configuration.

There may be intermediate partition walls extending between said side walls.

According to a further preferred feature, the cage comprises hingedly interconnected side panels defining said walls and transverse partition panels interconnecting the side walls, said cage being movable between a collapsed condition in which the side panels are folded concertina fashion and an erected condition in which the side panels and partition panels form a row of cavities, said lining material lying to the inside of said side panels.

The lining material is preferably a geo-textile felt material.

The cage structures according to yet a further aspect of the invention can be utilized for conventional gabion structures and in accordance with this aspect there is provided a cage structure for use in providing a structural block comprising pivotally interconnected open work mesh panels which provide cage walls and are pivotally interconnected so as to be movable between a collapsed condition and an erected condition, in which latter condition the cage structure defines one or more cavities to be filled with building materials.

Such a cage is simply erected at the site by relative pivoting of the panels, and then the erected structure is filled adjacent the panels at least with the filling material being stones, rocks, boulders or the like which are individually larger in dimension than the dimensions of the apertures in the open work mesh.

It is known to provide gabion cages in the form of flat blanks made up of portions which are pivotally interconnected so that the cage can be erected on site, but such known cage structures comprise a base panel with side panels hinged to the edges thereof. On site, the side panels are hinged to vertical positions, and the meeting vertical edges of adjacent sides are connected by suitable clips which are applied by means of an applicatioin gun, thereby to create the gabion box structure which has an open top. The thus constructed gabion cage is then filled with the filling material.

One shortcoming of such a cage is that the clips must be applied by a power gun on site, which is undesirable, because it requires the provision of power on the site which has its own inherent problems, and secondly, when such a gabion cage is loaded i.e. filled with filling material, there is an outward pressure on the sides which concentrates on the said clips, and if the clips are not therefore properly and securely applied, then failure of the clips can and does take place.

Preferably, the cage structure defines two side walls and two end walls which are pivotally interconnected at the corners, and a base panel pivotally connected to a lower edge or one of the side panels.

With the preferred gabion cage structure in accordance with the present invention, the sides of the gabion cage are hingedly interconnected under factory conditions, and a base is hinged to one only of the sides so that for transportation, the cage can be collapsed by relative pivoting of the sides, parallelogram fashion, and the base can be folded over onto the flattened sides, in fact as described in the said co-pending application.

If the cage has internal partitions, these can also be pivotally connected to opposite sides when the cage is constructed under factory conditions. By constructing the cage under factory conditions, it is easier to ensure that the applied clips will be effectively applied so as properly to perform the function of holding the gabion cage sides together.

On site, the cage is simply erected by unfolding the base and moving the sides to the erected condition. The remaining sides of the base may be clipped to the other sides of the gabion cage structure if necessary, but as will be understood from the nature of filling of the cage, the joint between the base edges and the sides is not required to be as high in strength as the joints between the adjacent sides and partition panels.

The cabion cage may also be provided with a top panel, of similar size to the base, but hinged when factory constructed to the side opposite the side to which the base is hinged.

In another embodiment of such a cage, in the cage structures a plurality of pivotally interconnected side panels form the side walls, and the side walls are connected by partition panels which are pivotally connected thereto, and the cage structure can be moved to a collapsed condition wherein the side panels are folded concertina fashion and a flexible cord is connected to the partition panels and serves as a means for erecting the cage structure by pulling on said cord to cause the cage to erect to a form defined by a plurality of sub-cages arranged in a row.

Gabion cages constructed in accordance with this aspect of the invention do not require the utilisation on site of power tools for the application of connecting clips as the applied clips which connect the base and sides and top of sides if a top is provided can be of a type which is applied by hand.

Another advantage of the cage according to this aspect of the present invention is that it can be provided under factory conditions with partition panels. The conventional erectible gabion cage requires to have the partition panels connected on site.

In accordance with yet a further aspect of the present invention, a cage structure can be fabricated under controlled conditions e.g. factory conditions, so that it has a flattened or compressed minimum volume form, and then can be moved to erected condition on site and filled on site to form a shoring or building structure or the like, the gabion cage structure being characterised in that in the flattened or compressed form its side walls are concertina folded.

The cage structure may be used in conjunction with a flexible member such as a rope or cable connected to respective panels of the structure to limit the extent to which it can be opened, so that for example the resulting opened out cage structure will have a particular form.

In one embodiment of this aspect of the invention, in the opened out form the cage structure is elongated and is made up of polygonal cavities arranged in a row, with one panel being common and defining a side of each cavity of adjacent polygonal cavities. The cavities preferably are hexagonal in shape and the common panels are partition or diaphragm panels, whilst the remaining panels, four to each cavity, define the sides of the elongated structure.

The said flexible member when provided preferably is anchored to the partition panels to limit the extent to which they can be moved apart as the collapsed structure is moved from the flattened or compressed condition to the fully opened condition.

The cage structure preferably is associated with lining membrane means, and preferably such means comprises lining material lying to the inner sides of the side panels. The membrane means preferably comprise two elongated strips of the lining material which lie to the inner sides of the side panels and extend for the length of the structure. In this connection the partition panels have to be coupled to the side panels by a means which passes through the lining strips.

The panels are preferably of open work wire mesh.

Such fastening means may as disclosed above application comprise clips or the like.

The blocks according to the invention can be used for earth shoring purposes and when sprayed with the resin composition will provide attractive wall surfaces. Alternatively, the blocks can be used for providing barracades, temporary accommodations, army compounds, shelters for defence against attack, sea defences and any of a large number of building structures which can be created using building blocks.

The flexible barrier layer when used to separate the filling material from the cage structure may be any suitable, but we have found that the bonded fabric felt materials of the geotextile nature have been particularly suitable.

Embodiments of the invention, and the advantageous features thereof, will now be described, by way of example, with reference to the accompanying drawings, wherein.

Figure 1:
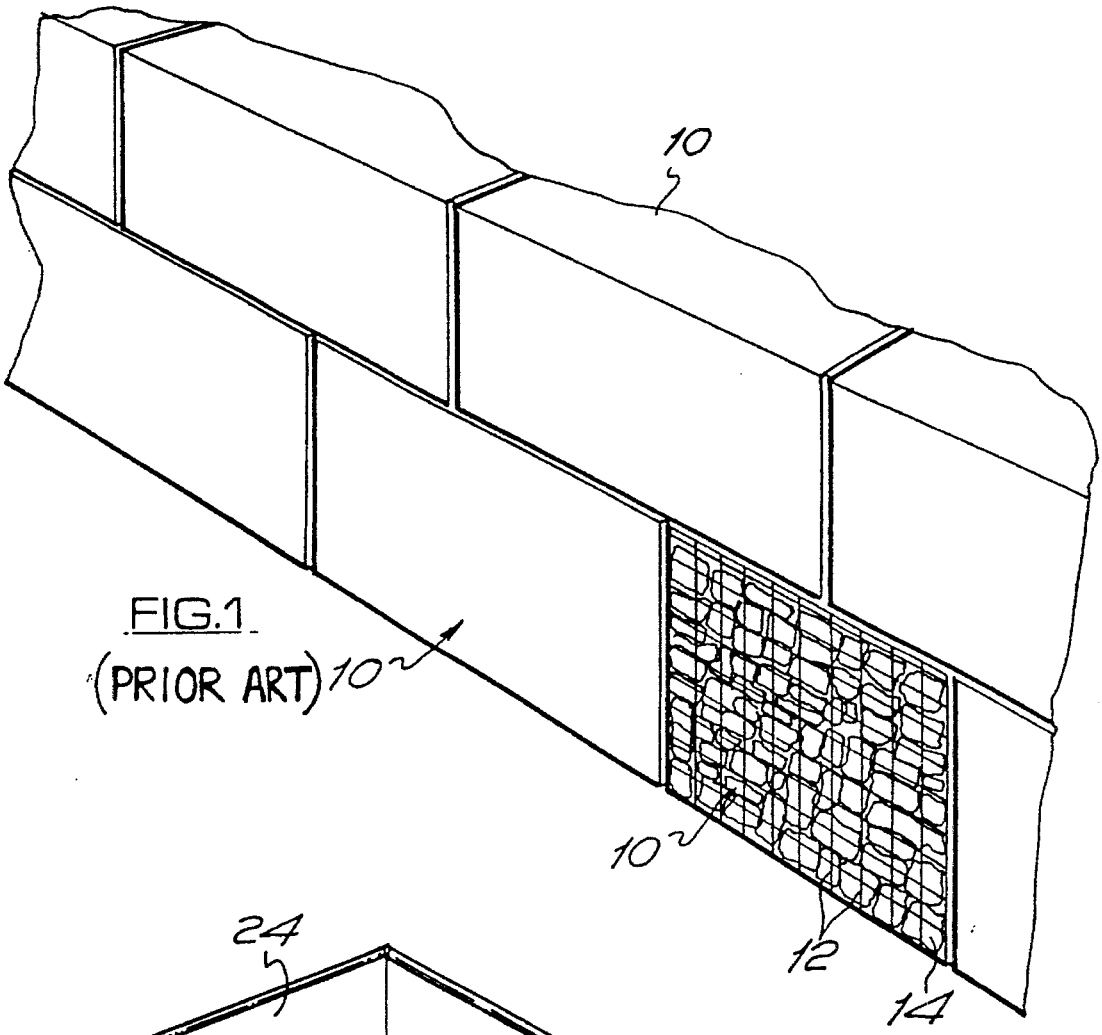
FIG.1 (PRIOR ART)
FIG. 1 shows in perspective elevation a shoring wall formed from gabions of conventional construction.

Referring to FIG. 1, conventional gabions 10 are in the form of massive blocks defined by metal wire mesh cages 12 in which are contained stones 14 and other rubble. The filling material for the cages at the wire mesh panels is of a size such that it will not pass through the meshes of the cage. The wires of the cage may be uncoated or coated with protective plastics material.

The use of gabions for wall structures, shoring walls, barracades, coastal supports is well known. The use of gabions effectively combats erosion and they are particularly suitable for stabilising and strengthening embankments. The gabion cages are filled on site by relatively unskilled labour but they still require the use of fairly large dimension filling stones. Gabions have the advantage that they do have some flexibility to allow some movement and change in shape should local ground subsidence occur. Their strength and integrity are retained. The gabions furthermore are porous and it is not therefore normally necessary to incorporate drainage systems.

Figure 2:
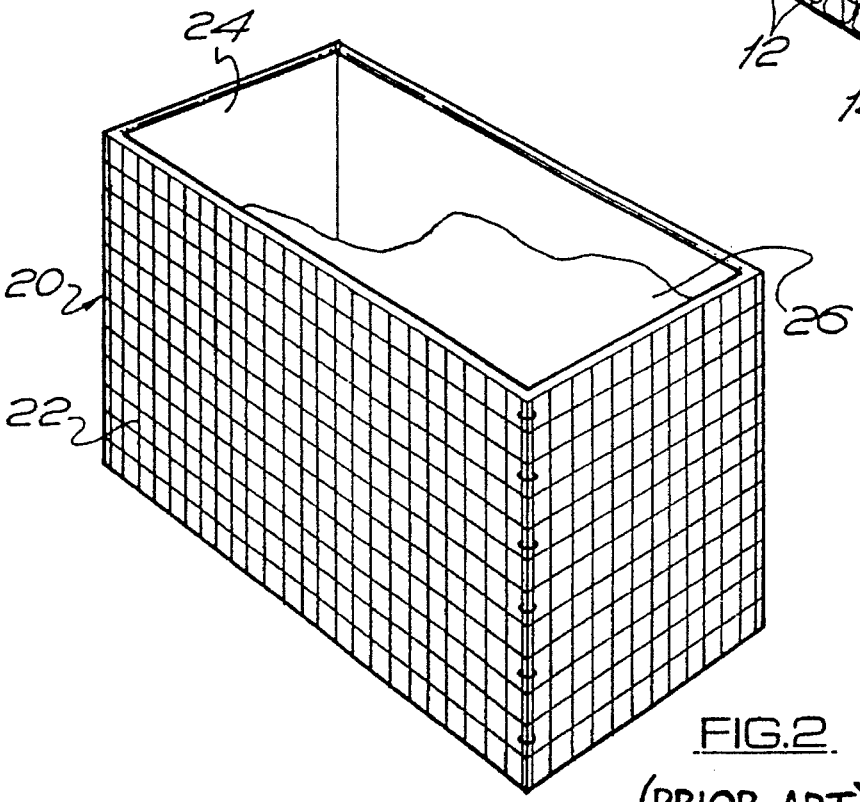
FIG.2 (PRIOR ART)
FIG. 2 shows a gabion according to the concept of the present invention.

FIG. 2 shows a gabion according to the present invention, and it will be seen that the gabion 20 comprises a gabion cage 22 of steel rods or wires as in the conventional gabion 10, but in addition the steel cage is lined by flexible lining material 24 which enables the gabion to be filled entirely with a ballast material of a considerably smaller particle size. For example sand can be used as the ballast material. This enhances the utility of the gabion structure. The gabion shown in FIG. 2 is illustrated as being partially filled with sand or like loose material 26. In practise when the gabion is filled, it will be closed by means of a wire mesh lid, and similarly a layer of the flexible material 24 may be placed over the filling. The flexible sheet material which is used as the covering may be any suitable, but we have found that bonded felts of synthetic fibres which are of considerable tensile strength, but are porous so as to allow liquid to pass therethrough, but not the particular ballast material, are particularly suitable.

Figure 6:
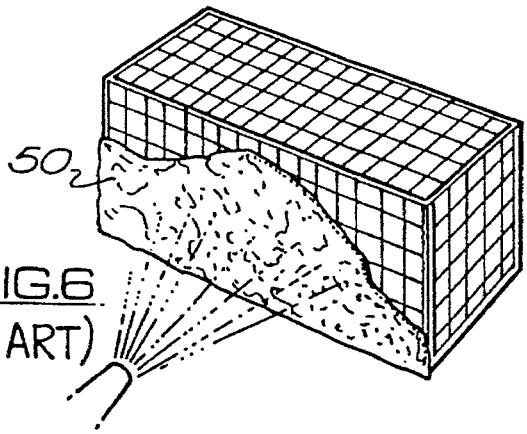
FIG.6 (PRIOR ART)
FIG. 6 shows how a gabion according to the invention may be coated to provide a decorative, protective finish.

According to a further feature of the present invention, when the gabion 20 has been filled and lidded, and is in position in a wall or shoring structure, the exposed faces are then sprayed with a curable synthetic resin composition 50 as shown in FIG. 6 in order to form a relatively even and textured surface over the metal cage, to give the appearance for example of a rough cast wall. The resin which is used subsequently cures and forms an aggresive bond with the sheet material 24 and the metal cage 22. The sheet material is absorbent and soaks up the resin so forming a good bond.

Figure 7:
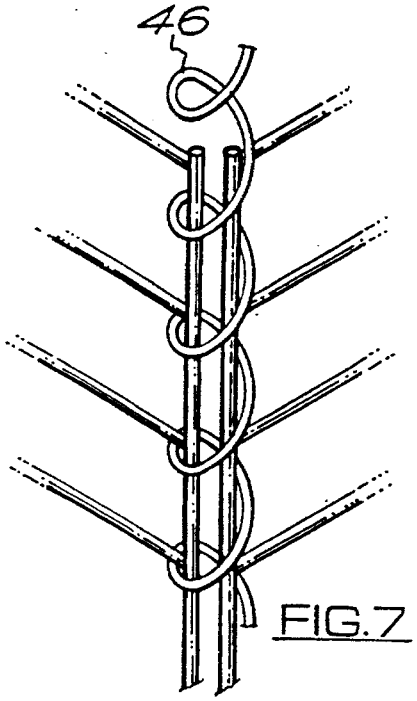
FIG. 7 illustrates a spiral clip usable for interconnecting panels of the gabion cage shown in FIG. 2.

In the known gabion structures, the metal cage is laid out as a blank and is folded to erected condition, the adjacent edges of the panels being clipped together with stainless steel clips or galvanised spring steel ring clips or helical binders. In the aspect of the invention illustrated in FIGS. 3, 4 and 5, the wire mesh panels 30, 32, 34, 36 and 38 making up the cage blank are suitably secured together so as to be relatively hingeable, and the blank is covered by means of a sheet 40 of the said flexible material, which is secured to the said panels. To erect the cage and the sheet material 40, initially panels 34 and 30 are folded to the position shown in FIG. 4, following which the excess portions of the material 40 at the comers are tucked inwardly as indicated by arrows 42, and then the end panels 32 and 36 are turned upwardly until the position shown in FIG. 5 is reached, the said extra portions of the material 40 forming flat fillets 44. The cage is now ready for filling with the filling material which may be loose particulate material such as sand. FIG. 7 shows how a helical spring binder clip 46 may be used for connecting the ends of the respective panels, but any suitable connecting device can be used.

The gabion shown in FIG. 5 after filling with the ballast material may be closed by means of a wire mesh lid panel as in the conventional arrangement.

Figure 3:
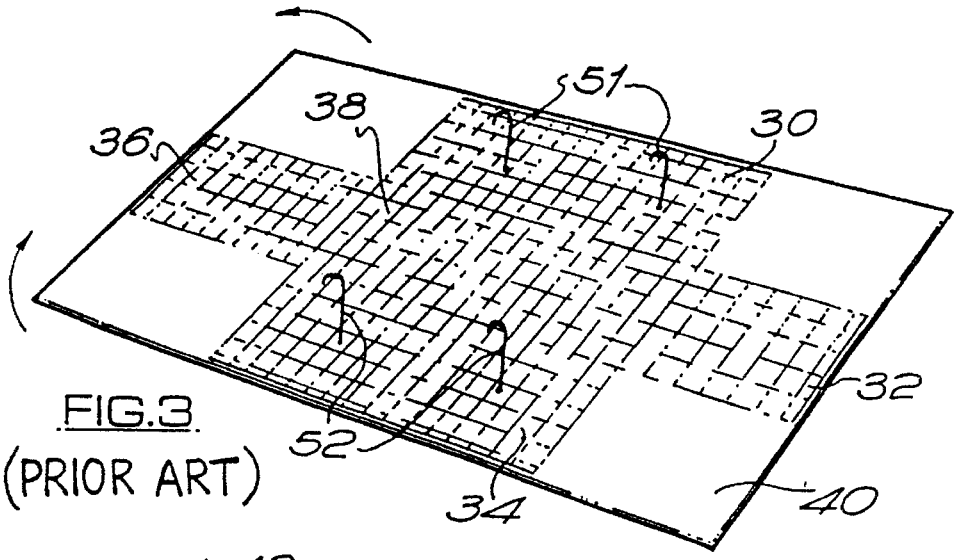
FIG.3 (PRIOR ART)
FIGS. 3, 4 and 5 show a method of constructing a gabion according to the invention using a preformed blank.
Figure 4:
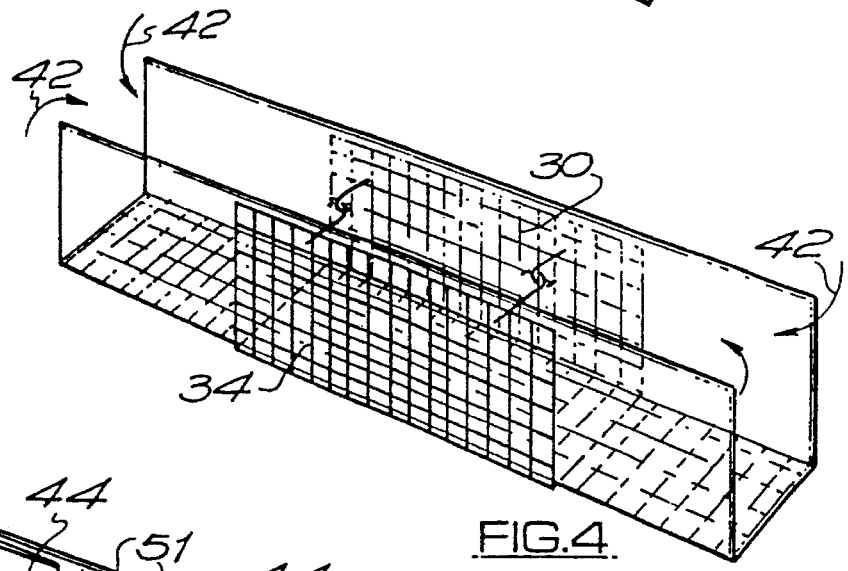
FIG.4 (PRIOR ART)
Figure 5:
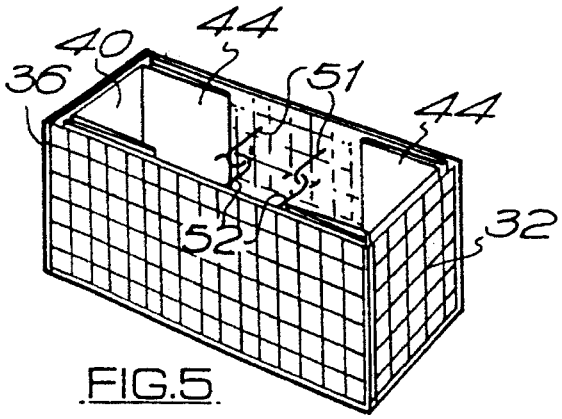
FIG.5 (PRIOR ART)

It is to be noted from FIGS. 3, 4 and 5, that connected to the panels 30 and 34 are tie hooks 51 and 52. These hooks link with each other as shown in FIG. 4 when the panels 30 and 34 are erected, in order to keep the panels connected whilst the material 40 is tucked at the corner and then the panels 32 and 36 are folded to the upright position. The use of the ties to hold the panels 30 to 36 together at the corners effects completion of the structure ready for filling.

Again as with the gabion shown in FIG. 2, the exterior of the gabion or that portion which is visible can be sprayed with a curable synthetic resin in order to form a decorative finish, and in addition to protect the sheet material 24 in the case of FIG. 2, and 40 in the case of FIG. 5.

Where the gabions are coated, it may be desirable to ensure that the gabions remain permeable to water to ensure that water can drain through the gabions as happens with the conventional gabions.

The sheet material serves to permit the use of much finer particles as ballast material. Also soil and ash can be used as ballast material, and these materials by and large tend to be much more readily available than the conventional materials such as brick, broken concrete, granite, limestone, sandstone, shingle and slag and stone as used in the conventional gabions.

The gabions may be filled on site by any suitable means such as hand shovels, augers, pumps, earth movers of various types, making filling much quicker than the method used for conventional gabions.

The gabions according to this embodiment of the invention have a number of advantages including the following:

Wet sand or pebbles pumped by a suitable pump can be used as the gabion infill material especially when the site is a beach area.

The gabions according to the invention can be finished cosmetically by the use of the coatings.

The coatings can be selected to be resistant to chemical, salt water, mineral, wind, rain and sand attack.

The gabions according to this embodiment of the invention can compete effectively with equivalent concrete structures.

Reference is now made to FIGS. 8 to 14 which illustrate the application of the invention to the production of concrete structures.

Figure 8:
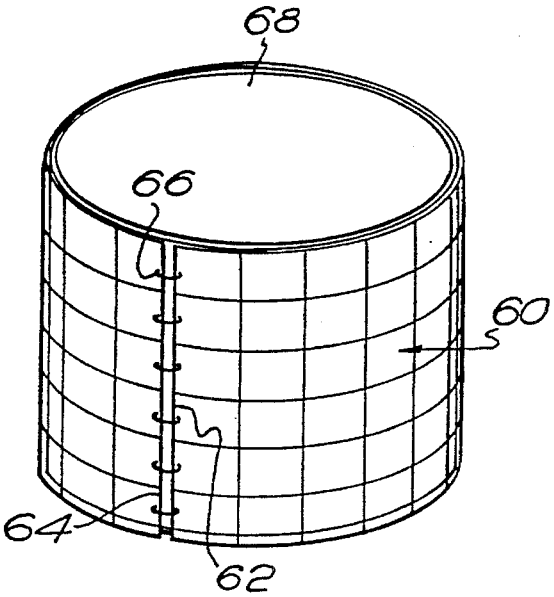
FIG. 8 is a perspective view of a cage means according to another embodiment of the present invention.

In FIG. 8, a cage means comprises a strip of steel wire or rod mesh turned into a cylindrical configuration as will be clear from FIG. 8. The mesh 60 has its free ends 62, 64, connected by ring clips 66 which may be applied on site.

Inside the cylindrical mesh cage is a lining material 68, which is supported by the cage and comprises a felt material which is porous to water but yet prevents the solid material of the concrete from passing therethrough.

Figure 9:
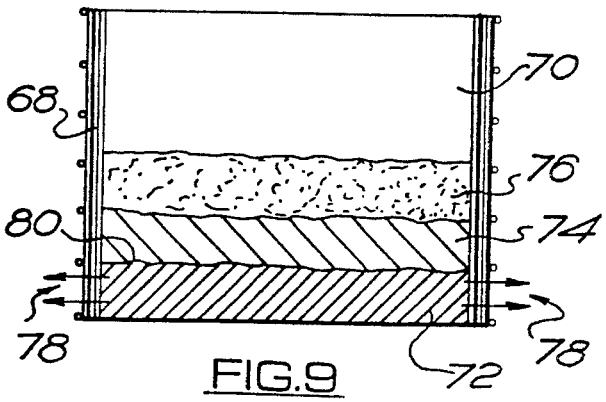
FIG. 9 shows the cage means of FIG. 8 in sectional elevation when partially filled with concrete.

To form a concrete structure using the cage means shown in FIG. 8, it is simply a matter of filling the interior of the cage with concrete as shown in FIG. 9. As shown in that Figure, the concrete is charged into the cavity 70 in layers 72, 74, 76, and so on until if required the cage is filled. When each layer of concrete is poured into the interior, it is allowed to stand for a predetermined period of time so that the concrete will initially set. As soon as the concrete is charged into the interior of the cage the water percolates through the material 68 and through the mesh, as indicated by arrows 78, so that in effect drying of the concrete takes place much quicker than it would do in conventional shuttering as the water can escape from the concrete using a conventional shuttering method only from the top surface 80. With this method, therefore, the concrete cures quicker and the subsequent layers 74 and 76 can be applied so that the cavity is filled quicker than with conventional shuttering. In addition, for the conventional shuttering of cylindrical concrete structures, special curved fibreglass moulds must be used, and retainers and reinforcing have to be fitted inside the moulds. The erection of moulds on site is time consuming and requires skilled personnel. The provision of a simple cylindrical cage with the material liner 68 provides a much simpler method of shuttering the concrete.

The cage 60 can of course be any suitable length for example to provide cylindrical columns of concrete, and wire mesh partition discs may be arranged inside the cylindrical mesh cage 60 in order to provide reinforcement if required, and in order to provide a means for supporting reinforcing steel bars in the manner as will be described in relation to FIG. 11.

The cylindrical mesh 60 can be cropped to length before or after filling same with concrete.

When the concrete has cured, the mesh 60 can remain connected to the concrete or it can be removed if required, and to some extent this will depend upon whether or not the exterior of the concrete structure in the final building or other location in which it is used is visible. If it is not visible there is no need to effect any additional treatment to the exterior of the concrete structure, but if it is visible, it can be treated by shot-blasting in order to remove the material 68, followed by a spraying of the structure by the thermo-setting resin composition 82 as shown in FIG. 10, as such thermo-setting resin composition will form a better bond to the concrete than it will do to the material 68.

Figure 10:
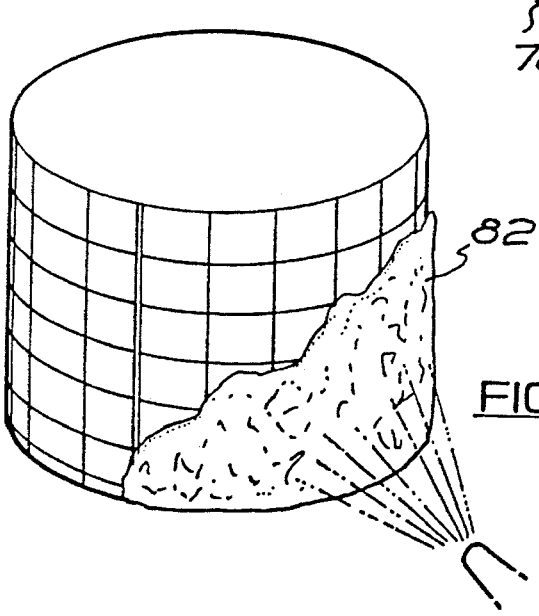
FIG. 10 shows a concrete structure created using the cage means of FIG. 8.

In the embodiment shown in FIGS. 8 to 10, the material 68 lines only the inner cylindrical portion of the cage 60, but it could line the base if required. Also the cage 60 could be provided with a circular lid of mesh material which is placed in position after the topmost layer of concrete is inserted into the cavity.

The mesh cage in conjunction with the material 68 provides an effective shuttering means for concrete which is much simpler to handle and construct and is easier to form into the more difficult shapes such as cylindrical shapes.

Figure 14:
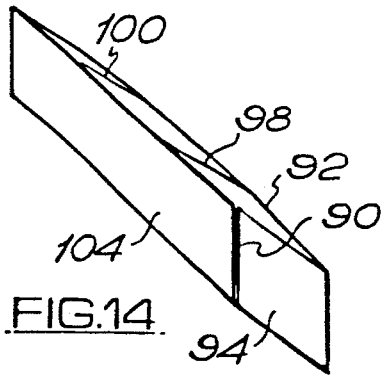
FIGS. 13 and 14 show how the cage means of FIG. 11 may be folded to a collapsed condition.
Figure 13:
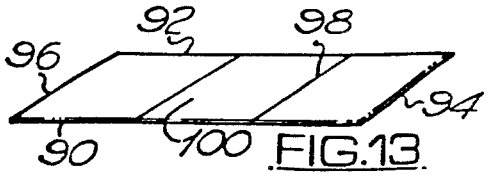

It is to be mentioned that this aspect of the invention is not to be considered as being limited to any particular configuration of cage, as the cage configuration will depend upon the eventual shape of the concrete structure required. FIG. 11 shows a form of cage which is suitable for providing concrete structures in the form of blocks or beams. The cage is provided with sides 90 and 92, ends 94 and 96, cage partition panels 98 and 100, each of these components being of a wire mesh construction. The respective parts are hinged together by means of clip hinge rings 102 which enable respective portions to be relatively hinged so that the interconnected portions can be relatively hinged to a flattened condition, as shown in FIG. 14. Thus, the top 104 can be hinged as indicated by arrow 106 relative to the side 90, as the base 108 can be hinged as indicated by arrow 110 relative to the side 92. The sides 90 and 92 can be displaced relative to each other as indicated by arrows 112 and 114 in FIG. 12, so that the sides 90, 92, the end panels 94 and 96 and the partition panels 98 and 100 move to a flattened condition as indicated by FIG. 13. When these panels and walls are so moved to the flattened condition the top 104 and bottom 108 can be swung onto the outsides of sides 90 and 92 to provide the-flattened assembly.

Such a cage can obviously be readily manufactured under factory conditions and transported to site where it is filled with concrete. It should be mentioned that the inner surfaces of the sides 90 and 92 and the inner surfaces of the ends 94 and 96 will be lined with the material 68 in order to contain the concrete. If appropriate, the base and/or top inner surface may also be lined with this material.

Figure 11:
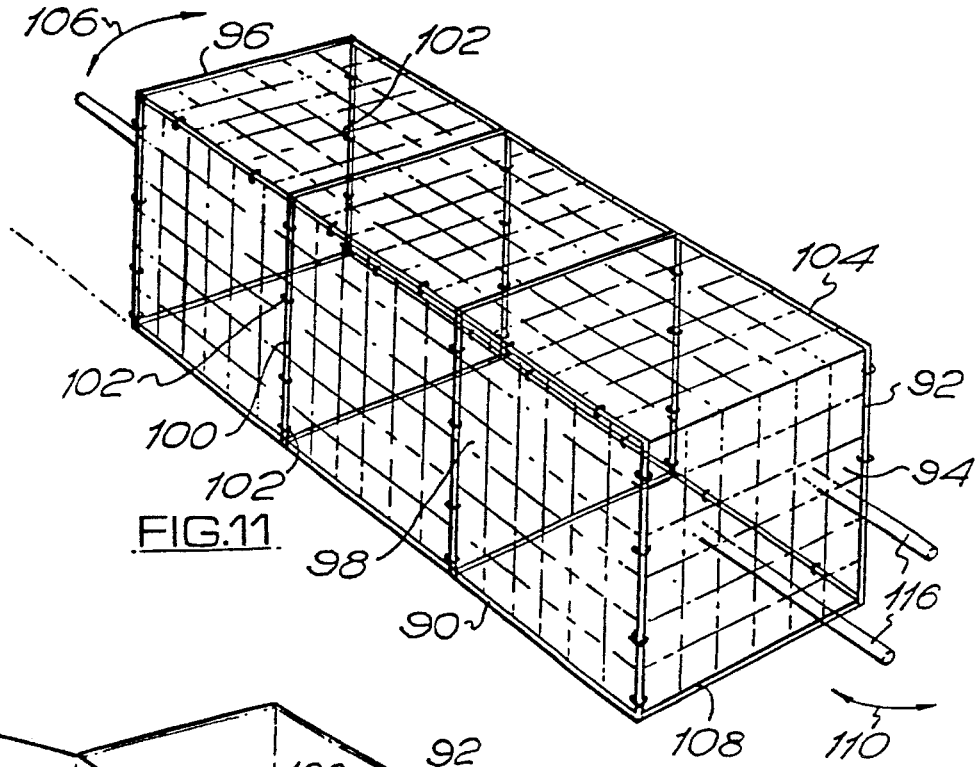
FIG. 11 shows a cage means useful in preparing the concrete structure in bar or block form.
Figure 12:
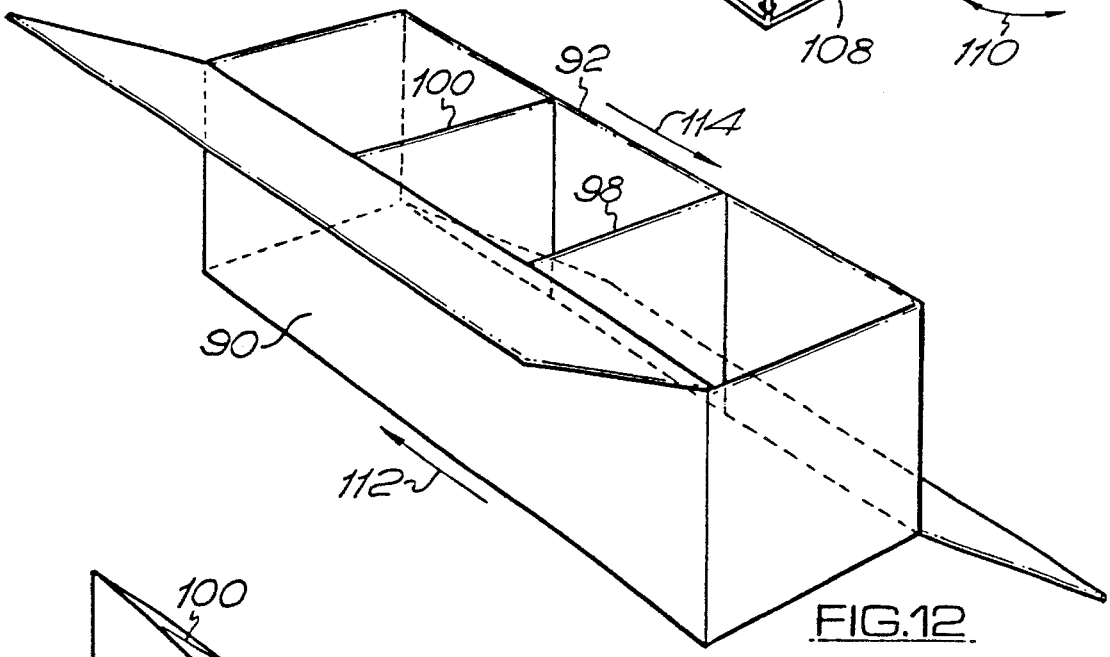
FIG. 12 shows the cage structure of FIG. 11 in an alternative position.

A concrete block or beam can be formed simply by filling the cage shown in FIG. 11, when of course the top 90 will be open and this top will be closed when the cage has been filled with concrete. The inside of the top 90 can also be lined with material 68 if required, but it is felt that this will be unlikely.

The same benefits are achieved concerning the curing of the concrete as are achieved with the FIGS. 8 to 10 embodiment, and FIG. 11 also shows how reinforcement steel bars 116 will be supported on the ends 94 and 96 and also on the partitions 98, 100 simply by being passed through the mesh apertures in these components and no additional location means is required for the reinforcing bars. As many reinforcing bars as required may be utilised in connection with the cage.

Again as with the FIGS. 8 to 10 embodiment, the material 68 may be sand-blasted so as to remove same and the resulting concrete structure may be covered by means of the thermo-setting resin 82.

The concrete structures constructed in accordance with this embodiment of the invention may be used in any suitable application, such as foundations, ring beams, bases, columns, steps, retaining walls and in any application where shuttering is normally required.

Concrete blocks housed in cages maybe used for breakwaters, or sea walls, as described herein.

The clip rings 102 may be simple coiled lengths of steel which can readily be applied to the cage bars by hand.

The invention also provides a collapsible cage structure for use in connection with the method.

In another embodiment of the invention, a wall is created on a base surface by the placement of spaced mesh strip spaced by the required thickness of the wall. Spaced mesh strips may be interconnected by cross-partitions for reinforcement, and concrete is simply poured into the cavity between the spaced strips after the lining of same with the containment material. Such method may be suitable for creating retaining walls of circular configuration and which encircle tanks containing corrosive and dangerous chemicals, so that such retaining walls will form a well around the tank in order to contain the dangerous chemical in the event that there is leakage of same.

Another advantage of this aspect of the invention is that relatively wet concrete can be used in the process of producing the concrete structures because of the rapid expression of the water from the concrete when the concrete is poured into the cage. Because the concrete is relatively wet, air bubbles therein can escape readily giving more homogeneously cured concrete. This compares significantly with the prior art when shuttering is used for forming concrete structures, because in such case there is usually a requirement for the concrete to be delivered in a relatively dry condition e.g. 75 slump. It is more desireable to have the concrete relatively wet, but the disadvantage of this is that relatively wet concrete is more difficult to work with in a shuttering method. No such difficulty arises in accordance with the method of this aspect of the present invention.

Figure 15:
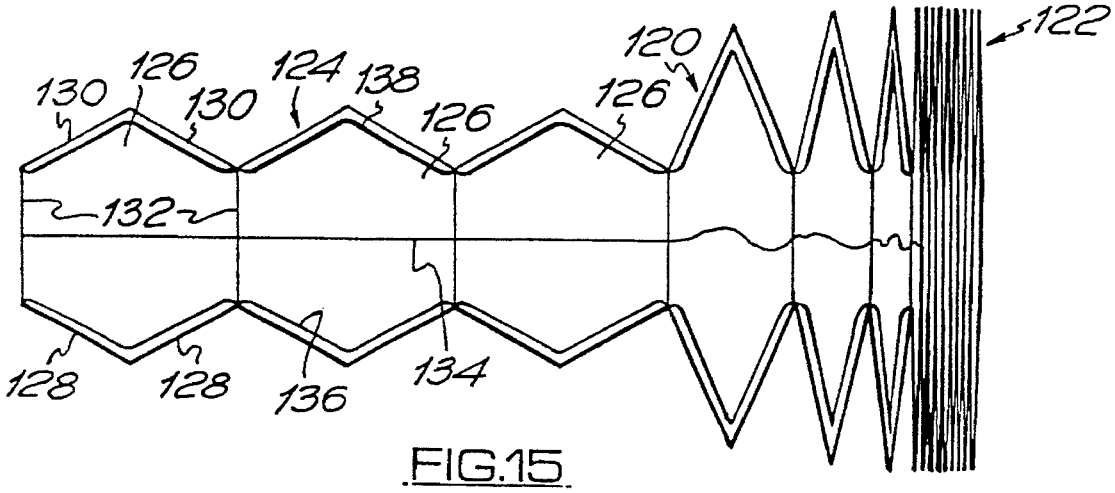
FIG. 15 is a plan view of a gabion cage structure according to another embodiment of the invention which is being moved from the flattened compressed condition to the erected condition.
Figure 16:
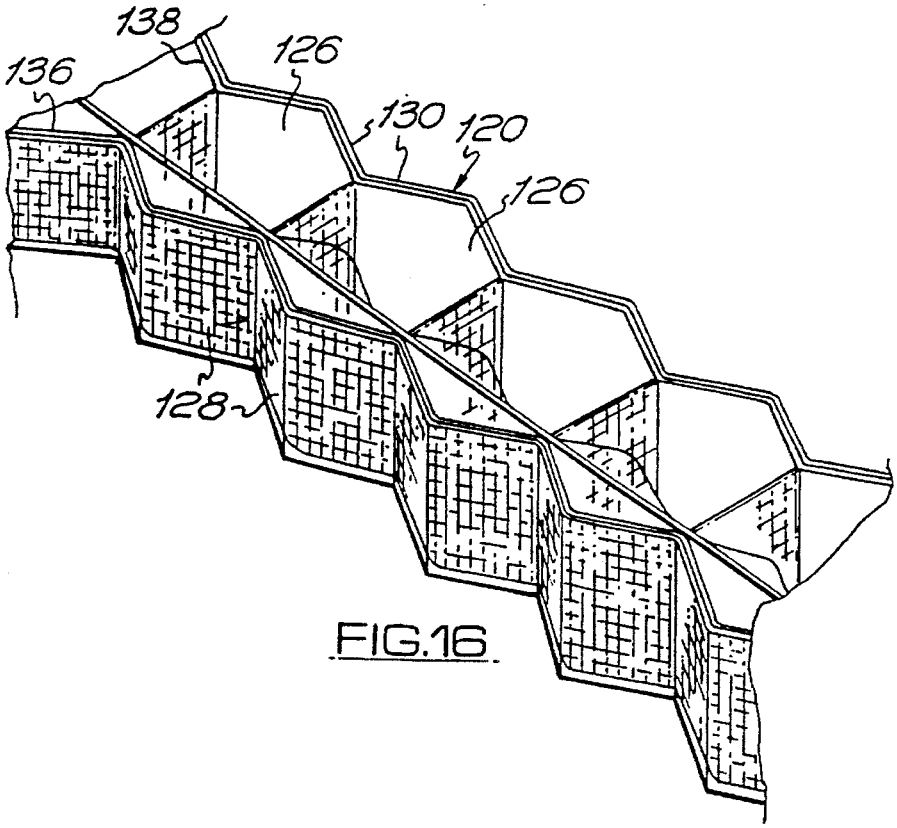
FIG. 16 is a perspective view of the cage structure of FIG. 1 in the erected condition.

Reference is now made to FIGS. 15 and 16 which show a particularly suitable form of cage according to another aspect of the present invention.

Referring to FIGS. 15 and 16, a cage structure 120 as shown in FIG. 15 is adapted to have a flattened state, indicated by reference 122 in which it takes up minimum volume, but can be opened out from the flattened condition to elongated form as indicated by reference numeral 124 in FIG. 15. The elongated form as shown is made up of polygonal, in this case hexagonal, cavities 126 each made up of front side panels 128, rear side panels 130 and partition or diaphragm panels 132. The panels 128 to 132 are of equal width but this need not be the case. In the flattened condition as indicated by reference 120, the panels 128, 130 and 132 of each cavity are face to face. As can be seen from FIG. 15, each partition panel 132 is common to each pair of adjacent cavities 126.

A flexible member in the form of a rope or cable 134 is connected to the centre of each of the partition panels 132, so that the cable limits the extent to which the structure erects or more particularly the extent to which each of the cavities can erect so that it will have the hexagonal form shown in FIG. 15.

Lining the inner sides of the panels 128 and 130 are flexible membrane sheets 136 to 138 which form retention means for retaining the material which is eventually charged into the cavity 126 to fill same for the forming of the eventual shoring or building structure.

If reference is made to FIG. 16 the erected opened structure is shown, and the cavities 126 can simply be filled with the ballast material and/or concrete. If the linings 136 and 138 are omitted, then the ballast material must be of a size as not to pass through the mesh of the panels 128 and 130.

When the membranes 136 and 138 are provided, any suitable fill material can be used.

The gabion structure according to this aspect of the present invention may take other forms than that described, and it can be used in connection with any of the embodiments of the inventions disclosed herein. In particular, the respective panels 128, 130 and 132 may be inter-connected by the clip means or other means as described herein. It will be appreciated that such clips may require to pass through the membranes 136 and 138. The membranes may be constructed of materials as disclosed herein.

Resulting building or shoring structures constructed using the gabion structure as illustrated in FIGS. 1 and 2 may be used singly or in Juxtaposition or superposition or in any other appropriate combination depending upon the requirement of the final structure.

The cage structure illustrated may be of any size. For example each hexagonal cavity may be of the order of 3 meters wide by 3 meters high. Erection is obtained on site quite simply by pulling the structure to the erected condition.

Any feature of any aspect of the invention described herein can be used with any one or more of the features of any one or more of the other aspects of the invention as described herein.

The flexible material used in connection with the invention may include or comprise a layer of metallic foil, provided with apertures to allow liquid to drain therethrough. If the foil is used on its own the apertures therein must be of a size to allow liquid to drain therethrough but must hold back the filling material, which must be selected accordingly.

Also as an outer layer of the flexible material there cab be used the matting known as ANKERMAT which comprises coiled plastics filaments which can hold soil to make the block to be surfaced with soil to enable the growing of a grass covering thereover.

I claim:

1. A method of providing an on-site structural block comprising:

transporting to the site a cage structure in a collapsed flattened condition, said cage structure adapted to be filled with a filling material in order to provide a structural block, said cage structure comprising pivotally interconnected panels of open work mesh; and filling the cage at least partially with fluent solid material of a size too great to pass through the meshes of the cage, wherein the cage is erectable to the shape of the block to be provided by moving the panels apart, said panels comprising side panels defining side walls and end panels defining end walls pivotally interconnecting the side walls, said side and end walls being folded concertina fashion when the cage is in the collapsed condition, the cage being erectable into a condition for filling whereby the cage defines at least one cavity for receiving the filling material.

2. The method according to claim 1, wherein the panels of the cage structure further comprise partition panels pivotally interconnecting the side walls, and the cage is erectable into a condition for filling whereby the cage defines a row of side-by-side cavities for receiving the filling material.

3. The method according to claim 2, further comprising providing the cage structure with interconnected side panels and partition panels, and erecting the cage by moving the panels apart into a condition for filling whereby the cage defines a row of side by side hexagonal cavities for receiving the filling material.

4. The method according to claim 2, further comprising providing a flexible cord which passes through the partition panels and is connected thereto, and erecting the cage by pulling on the cord to move the partition walls apart and to unfold the side wall panels in sequence.

5. The method according to claim 1, wherein the filling material is taken from any of, or any mixture of, rubble, aggregate, stones, or the like.

6. The method according to claim 1, wherein the block is a wall structure.

7. The method according to claim 1, wherein the block is a shoring structure either by itself or in conjunction with other suitable blocks arranged adjacent thereto or on top thereof.

8. An improved cage structure of interconnected open mesh work panels, said improved cage structure comprising:

a.) first and second end panels;

b.) first and second side panels; and c.) at least one partition panel;

wherein said cage structure is transformable between a flattened condition and an erected condition, wherein said erected condition of said cage structure defines an upright block having corners with said first and second end panels forming first and second end walls and said first and second side panels forming first and second side walls, said end walls and said side walls being interconnected at said block corners, and each said partition panel being connected to and extended between said side walls so as to divide said cage structure into a plurality of cavities which may be filled with a filling material so as to produce a structural block;

the improvement being that said side panels, said end panels, and each said partition panel are permanently pivotally interconnected in both said flattened condition and said erected condition so as to allow said cage structure to be transformed from said flattened condition to said erected condition by relatively pivoting said end panels and said side panels.

9. The cage structure according to claim 8, wherein each said side panel is made up of permanently pivotally interconnected side panel sections which lie folded concertina fashion in said flattened condition.

10. The cage structure according to claim 9, wherein each said partition panel is permanently pivotally interconnected to said side panels where said side panel sections are permanently pivotally interconnected to each other.

11. The cage structure according to claim 8, wherein each said side panel is a single flat side panel having its two ends permanently pivotally interconnected to said first and second end panels, respectively.

* * * * *